US010479127B2

(12) United States Patent
Shikiya

(10) Patent No.: US 10,479,127 B2
(45) Date of Patent: Nov. 19, 2019

(54) SHEET-LIKE GOODS WITH STRING

(71) Applicant: DENTSU INC., Tokyo (JP)

(72) Inventor: Akira Shikiya, Tokyo (JP)

(73) Assignee: DENTSU INC., Tokyo (JP)

( * ) Notice: Subject to any disclaimer, the term of this patent is extended or adjusted under 35 U.S.C. 154(b) by 0 days.

(21) Appl. No.: 15/593,461

(22) Filed: May 12, 2017

(65) Prior Publication Data

US 2017/0326897 A1 Nov. 16, 2017

(30) Foreign Application Priority Data

May 13, 2016 (JP) ..... 2016-097172

(51) Int. Cl.

| | |
|---|---|
| ***A63H 33/00*** | (2006.01) |
| ***B65D 5/06*** | (2006.01) |
| ***B42D 15/04*** | (2006.01) |
| ***B42D 15/00*** | (2006.01) |

(52) U.S. Cl.

CPC ..... *B42D 15/042* (2013.01); *B42D 15/0093* (2013.01); *B42D 15/0073* (2013.01)

(58) Field of Classification Search

CPC ..... B29C 53/36; B29C 64/40; A45C 13/02; A45C 2003/007; A63B 21/0552; A63H 33/086; B60J 3/0204; B42D 15/042; B42D 15/0093; B42D 15/0073

USPC ..... 446/5, 148

See application file for complete search history.

(56) References Cited

U.S. PATENT DOCUMENTS

| | | | | | |
|---|---|---|---|---|---|
| 403,928 | A | * | 5/1889 | Emeric | B65D 33/10 383/117 |
| 505,688 | A | * | 9/1893 | Wendell | B65D 29/00 383/76 |
| 1,941,871 | A | * | 1/1934 | Struve | B65D 33/28 217/3 CB |
| 2,563,616 | A | * | 8/1951 | Perino | A45C 13/1046 383/6 |
| 2,565,283 | A | * | 8/1951 | Throckmorton | A45C 3/06 383/75 |
| 2,580,796 | A | * | 1/1952 | Kleiss | A45C 3/04 383/111 |
| 2,713,370 | A | * | 7/1955 | Quinn | B65D 29/00 383/102 |
| 3,797,043 | A | * | 3/1974 | Brument | A45F 4/02 2/69.5 |

(Continued)

FOREIGN PATENT DOCUMENTS

| | | |
|---|---|---|
| JP | 2004-121483 A | 4/2004 |
| JP | 2009-268758 A | 11/2009 |

(Continued)

OTHER PUBLICATIONS

International Search Report issued in Patent Application No. PCT/JP2017/018101 dated Jul. 18, 2017.

*Primary Examiner* — Nini F Legesse
(74) *Attorney, Agent, or Firm* — Pearne & Gordon LLP

(57) ABSTRACT

There is provided a sheet-like article with a string enabling use in two use forms (a first use form and a second use form). A sheet-like article 1 with a string has a first use form and a second use form. The sheet-like article 1 with a string includes a sheet-like main body 2, and a string body 4 inserted into holes 3 of the main body 2. In the sheet-like article 1 with a string, change from the first use form to the second use form is possible by pulling of the string body 4.

10 Claims, 9 Drawing Sheets

(56) References Cited

U.S. PATENT DOCUMENTS

| | | | | | |
|---|---|---|---|---|---|
| 3,807,200 | A * | 4/1974 | Liwski | D04B 1/22 | 66/170 |
| 5,135,222 | A * | 8/1992 | Spector | A63B 41/02 | 150/106 |
| 5,287,903 | A * | 2/1994 | Ambasz | A45C 7/0022 | 150/129 |
| 5,529,395 | A * | 6/1996 | French | B65D 65/08 | 229/87.03 |
| 5,653,337 | A * | 8/1997 | Cirigliano | A45C 3/00 | 206/373 |
| 6,264,391 | B1 * | 7/2001 | Kroha | A46B 5/04 | 15/227 |
| 7,926,702 | B2 * | 4/2011 | Childs | A45C 11/00 | 229/87.19 |
| 2010/0008601 | A1 * | 1/2010 | Prudencio | A01G 1/12 | 383/4 |

FOREIGN PATENT DOCUMENTS

| | | | |
|---|---|---|---|
| JP | 2012-126440 | A | 7/2012 |
| JP | 2015-212166 | A | 11/2015 |

* cited by examiner

SHEET-LIKE GOODS WITH STRING

CROSS-REFERENCE TO RELATED APPLICATIONS

This application claims the benefit of Japanese Priority Patent Application JP 2016-097172 filed on May 13, 2016, the entire contents of which are incorporated herein by reference.

BACKGROUND OF THE INVENTION

Field of the Invention

The present invention relates to a sheet-like article with a string having two use forms (a first use form and a second use form).

Description of the Related Art

Conventionally, various sheet-like articles (sheet-like goods) are used daily. For example, when a person makes a wish at a shrine or a temple, or when a person shows gratitude for granted wish, a votive horse tablet is used as a sheet-like article to be dedicated to the shrine or the temple. When a person presents his/her own name, belonging, contact destination, and the like, a business card is used as a sheet-like article to be given to another person. When a person presents his/her own name, a name plate is used as a sheet-like article to be worn by him/her. When a mark is put on a page of a book, a bookmark is used as a sheet-like article to be disposed between pages being read. Conventionally, various inventive ideas are given to these sheet-like articles (for example, the votive horse tablet) (refer to Japanese Patent Laid-Open Nos. 2004-121483, and 2009-268758, for example).

SUMMARY OF THE INVENTION

However, a use form of the conventional sheet-like article is limited to one.

The present invention has been made in view of the above problem, and an object of the present invention is to provide a sheet-like article with a string enabling use in two use forms (a first use form and a second use form).

A sheet-like article with a string of the present invention having a first use form and a second use form, the sheet-like article with a string including: a sheet-like main body; and a string body inserted into a plurality of holes of the main body, wherein change from the first use form to the second use form is possible by pulling of the string body.

According to this configuration, the sheet-like article with a string can be used in the two use forms (the first use form and the second use form). In this case, when the sheet-like article with a string is used in the first use form, the sheet-like article with a string can be changed from the first use form to the second use form by pulling of the string body of the sheet-like article with a string, and the sheet-like article with a string can be used in the second use form.

In the sheet-like article with a string of the present invention, the main body may include a first sheet, and a second sheet having a shape corresponding to the first sheet, in the first use form, an inner surface of an end of the first sheet may face an inner surface of an end of the second sheet, and in the second use form, an outer surface of the end of the first sheet may face an outer surface of the end of the second sheet.

According to this configuration, the string body of the sheet-like article with a string is pulled, so that the sheet-like article with a string in which the main body is formed by the two sheets (the first sheet and the second sheet) can be changed from the first use form in which the inner surface of the end of the first sheet and the inner surface of the end of the second sheet face each other, to the second use form in which the outer surface of the end of the first sheet and the outer surface of the end of the second sheet face each other.

In the sheet-like article with a string of the present invention, a first hole may be provided on a first side of the end of the first sheet, a second hole may be provided at a position corresponding to the first hole on a first side of the end of the second sheet, a third hole may be provided on a second side of the end of the second sheet, a fourth hole may be provided at a position corresponding to the third hole on a second side of the end of the first sheet, and in the first use form, the string body may be: inserted into the first hole from the inner surface to the outer surface of the end of the first sheet; inserted into the second hole from the outer surface to the inner surface of the end of the second sheet; inserted into the third hole from the inner surface to the outer surface of the end of the second sheet; and inserted into the fourth hole from the outer surface to the inner surface of the end of the first sheet.

According to this configuration, in the first use form, the string body is inserted into the first hole from the inner surface to the outer surface of the end of the first sheet, inserted into the second hole from the outer surface to the inner surface of the end of the second sheet, inserted into the third hole from the inner surface to the outer surface of the end of the second sheet, and inserted into the fourth hole from the outer surface to the inner surface of the end of the first sheet, and therefore the sheet-like article with a string can be changed from the first use form to the second use form by pulling of the string body.

In the sheet-like article with a string of the present invention, the first sheet and the second sheet may be connected to each other, in the first use form, the main body may be in a closed state, and in the second use form, the main body may be in an open state.

According to this configuration, the first sheet and the second sheet of the main body of the sheet-like article with a string are connected to each other, and change from the first use form of the state where the main body is closed to the second use form of the state where the main body is open is possible by pulling of the string body.

In the sheet-like article with a string of the present invention, in the first use form, the main body may be sealed by pasting in the closed state, and in the second use form, the sealing may be released, and the main body may be brought into the open state.

According to this configuration, in the first use form, the main body is sealed by pasting in the closed state, and the string body is pulled, so that the sealing is released, and the first use form can be changed to the second use form of the state where the main body is open.

In the sheet-like article with a string of the present invention, the main body may include a foldable bottom surface, in the first use form, the bottom surface may be in a folded state, and in the second use form, the bottom surface may be in a planarly developed state.

According to this configuration, the main body of the sheet-like article with a string includes the bottom surface, and the string body is pulled, so that the first use form of the state where the bottom surface is folded can be changed to the second use form of a state the where bottom surface is developed planarly.

In the sheet-like article with a string of the present invention, the main body may include a foldable pop-up part, in the first use form, the pop-up part may be in a folded state, and in the second use form, the pop-up part may be in a three-dimensionally developed state.

According to this configuration, the main body of the sheet-like article with a string includes the pop-up part, and the string body is pulled, so that the first use form of the state where the pop-up part is folded can be changed to the second use form of the state where the pop-up part is developed three-dimensionally.

According to the present invention, the sheet-like article with a string can be used in the two use forms (the first use form and the second use form).

DETAILED DESCRIPTION OF THE PREFERRED EMBODIMENT

Hereinafter, a sheet-like article with a string of an embodiment of the present invention will be described with reference to the drawings. In this embodiment, a sheet-like article with a string used for, for example, a votive horse tablet, a business card, a name plate, a bookmark, chopsticks case, or the like is exemplified.

Figure 1:
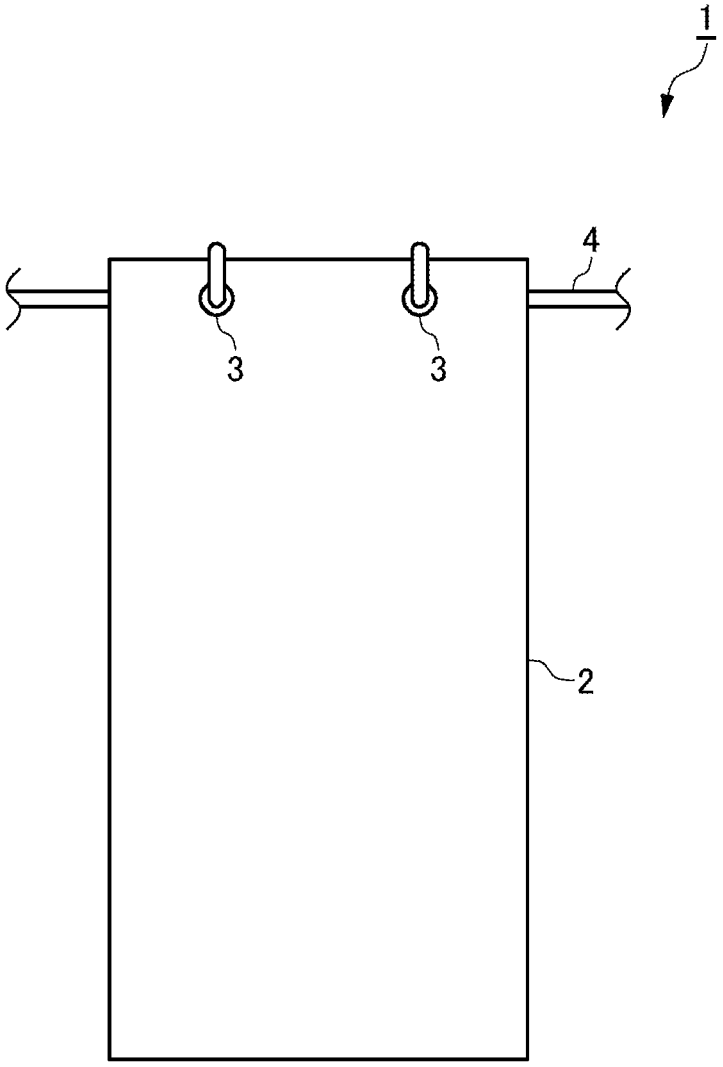
FIG. 1 is a plan view of a sheet-like article with a string according to an embodiment of the present invention.

A configuration of the sheet-like article with a string of the embodiment of the present invention will be described with reference to the drawings. FIG. 1 is a plan view illustrating the sheet-like article with a string of this embodiment. As illustrated in FIG. 1, a sheet-like article 1 with a string includes a sheet-like main body 2, and a string body 4 that is inserted into a plurality of holes 3 of the main body 2. The sheet-like main body 2 is made of a material (for example, stone paper or the like) having combustibility (property capable of burning), a water resistance property (property of strong resistance to water), a writing property (property capable of writing characters and the like by a pencil or a pen), and durability (property of hardly being torn).

Figure 2:
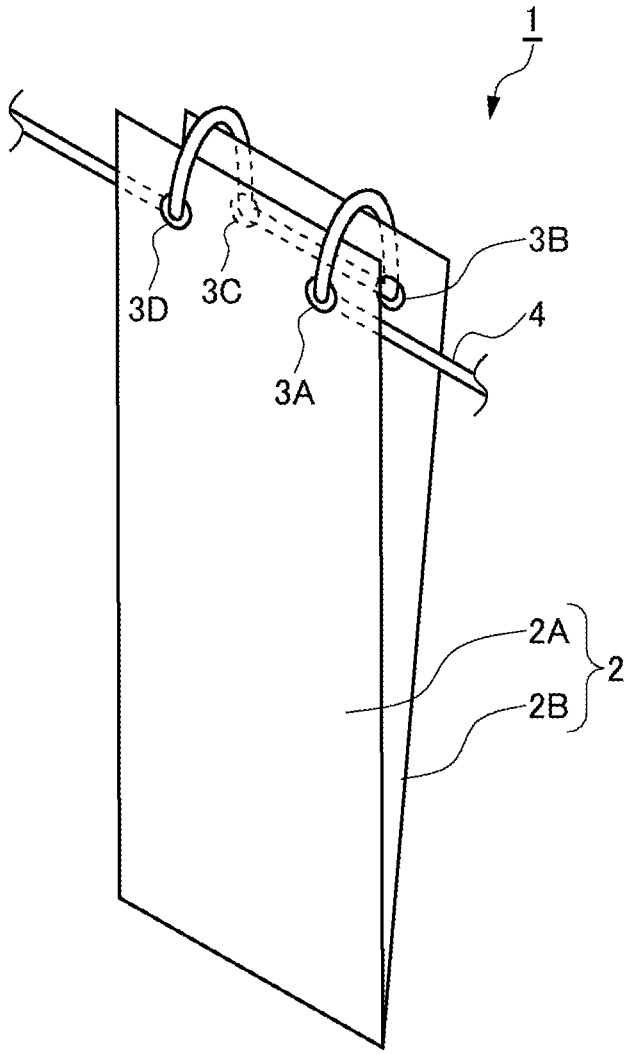
FIG. 2 is a perspective view of the sheet-like article with a string (first use form) according to the embodiment of the present invention.
Figure 3:
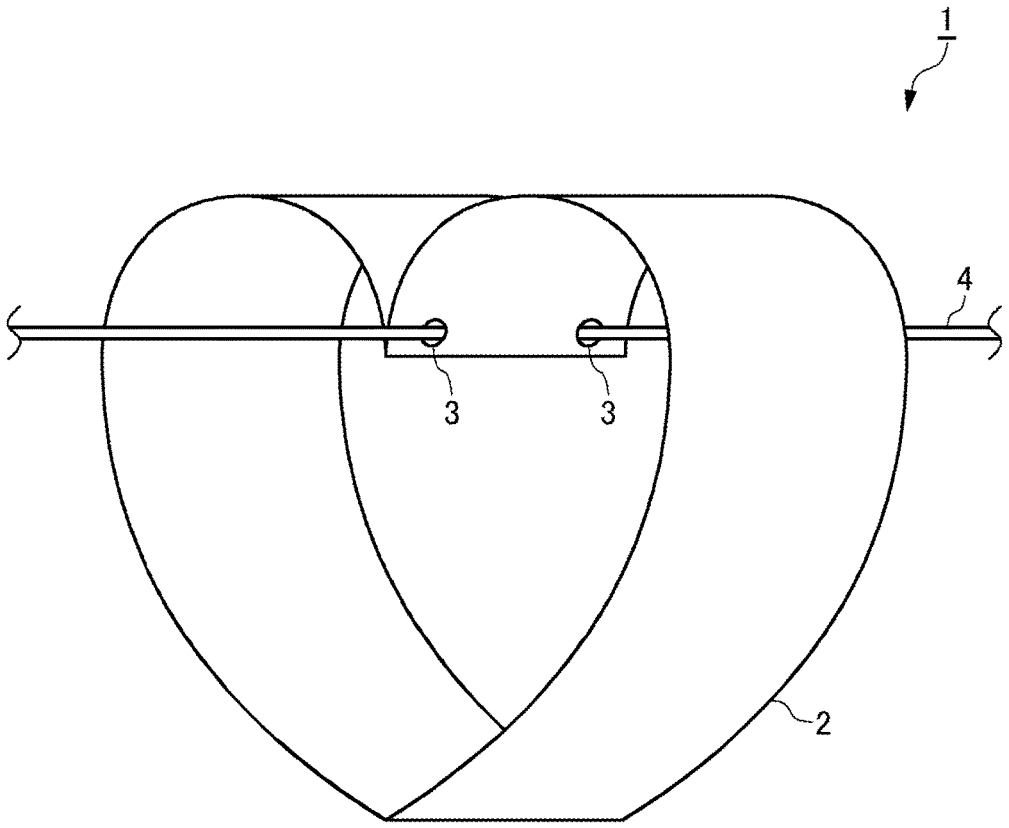
FIG. 3 is a perspective view of the sheet-like article with a string (second use form) according to the embodiment of the present invention.

This sheet-like article 1 with a string has a first use form and a second use form, and can be changed from the first use form to the second use form by pulling of the string body 4. FIG. 2 is a perspective view of the first use form of the sheet-like article 1 with a string of this embodiment. The first use form is, for example, a daily use mode. In the example of FIG. 2, the sheet-like article 1 with a string is in a state where the main body 2 of the sheet-like article 1 with a string is closed, and can be used as a votive horse tablet (or an amulet). FIG. 3 is a perspective view illustrating the second use form of the sheet-like article 1 with a string of this embodiment. The second use form is, for example, an unusual use mode. In the example of FIG. 3, the sheet-like article 1 with a string is in a state where the main body 2 of the sheet-like article 1 with a string is open, and can be used as a heart-shaped ornament.

As illustrated in FIG. 1 to FIG. 3, the main body 2 of the sheet-like article 1 with a string is composed of a first sheet 2A having a rectangular shape, and a rectangular shaped second sheet 2B corresponding to the first sheet 2A, and respective lower parts (lower part in FIG. 1) of the first sheet 2A and the second sheet 2B are connected to each other. In the examples illustrated in FIG. 1 to FIG. 3, respective upper parts of the first sheet 2A and the second sheet 2B are not connected to each other. However, the scope of the present invention is not limited to this, and the respective upper parts of the first sheet 2A and the second sheet 2B may be connected to each other.

A first hole 3A is provided on a first side of an end of the first sheet 2A, and a second hole 3B is provided at a position corresponding to the first hole 3A on a first side of an end of the second sheet 2B. Additionally, a third hole 3C is provided on a second side of the end of the second sheet 2B, and a fourth hole 3D is provided at a position corresponding to the third hole 3C on a second side of the end of the first sheet 2A.

In this sheet-like article 1 with a string (state of the first use form), the string body 4 is inserted into the first hole 3A from an inner surface to an outer surface of the end of the first sheet 2A, and inserted into the second hole 3B from an outer surface to an inner surface of the end of the second sheet 2B. Then, the string body 4 is further inserted into the third hole 3C from the inner surface to the outer surface of the end of the second sheet 2B, and inserted into the fourth hole 3D from the outer surface to the inner surface of the end of the first sheet 2A (refer to FIG. 2).

When the string body 4 thus inserted is pulled from both sides, the sheet-like article 1 with a string is changed from the first use form (state where the inner surface of the end of the first sheet 2A, and the inner surface of the end of the second sheet 2B face each other) to the second use form (state where the outer surface of the end of the first sheet 2A, and the outer surface of the end of the second sheet 2B face each other).

According to such a sheet-like article 1 with a string of this embodiment, the sheet-like article 1 with a string can be used in the two use forms (the first use form and the second use form). In this case, when the sheet-like article 1 with a string is used in the first use form, the string body 4 of the sheet-like article 1 with a string is pulled from the both sides, so that the sheet-like article 1 with a string can be changed from the first use form to the second use form, and the sheet-like article 1 with a string can be used in the second use form.

In this embodiment, the string body 4 of the sheet-like article 1 with a string is pulled, so that the sheet-like article 1 with a string in which the main body 2 is formed by the two sheets (the first sheet 2A and the second sheet 2B) can be changed from the first use form in which the inner surface of the end of the first sheet 2A and the inner surface of the end of the second sheet 2B face each other, to the second use form in which the outer surface of the end of the first sheet 2A and the outer surface of the end of the second sheet 2B face each other.

In this embodiment, in the first use form, the string body 4 is inserted into the first hole 3A from the inner surface to the outer surface of the end of the first sheet 2A, inserted into the second hole 3B from the outer surface to the inner surface of the end of the second sheet 2B, inserted into the third hole 3C from the inner surface to the outer surface of the end of the second sheet 2B, and inserted into the fourth hole 3D from the outer surface to the inner surface of the end of the first sheet 2A, and therefore the sheet-like article 1 with a string can be changed from the first use form to the second use form by pulling of the string body 4.

In this embodiment, the first sheet 2A and the second sheet 2B of the main body 2 of the sheet-like article 1 with a string are connected to each other, and change from the first use form of the state where the main body 2 is closed, to the second use form of the state where the main body 2 is open is possible by pulling of the string body 4.

As described above, the embodiment of the present invention is described by exemplification. However, the scope of the present invention is not limited to this, and changes and/or modifications can be possible in accordance with an object within the scope recited in the claims.

Figure 4A:
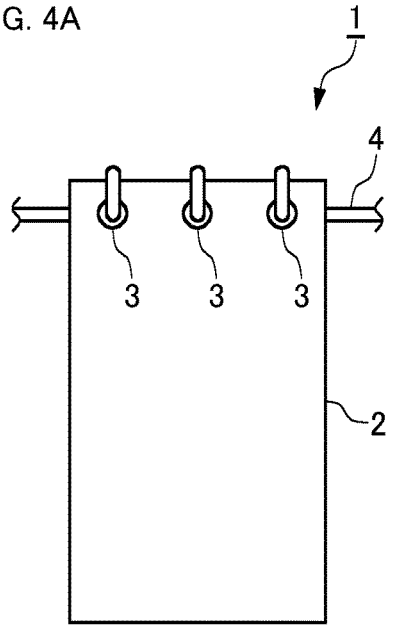
FIG. 4 A-C is a plan view of a sheet-like article with a string according to another embodiment.
Figure 4B:
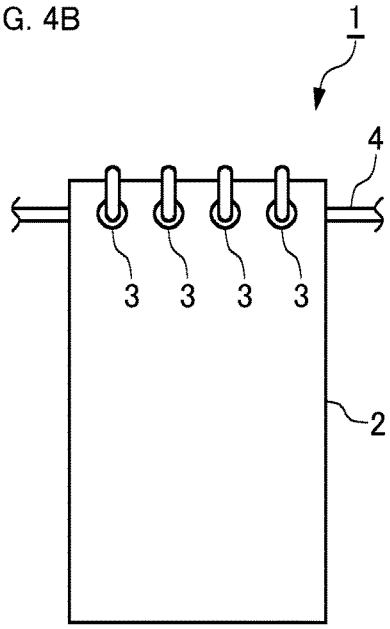
Figure 4C:
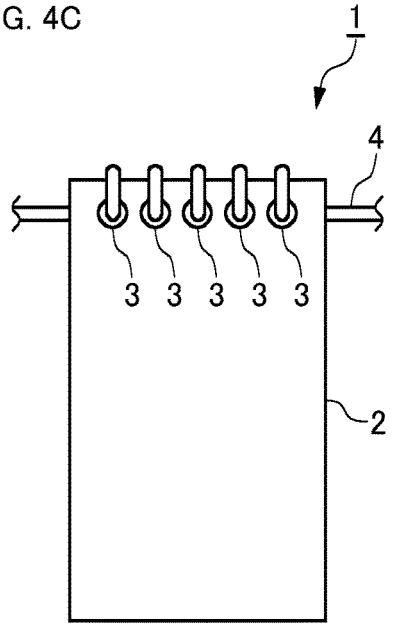
Figure 5A:
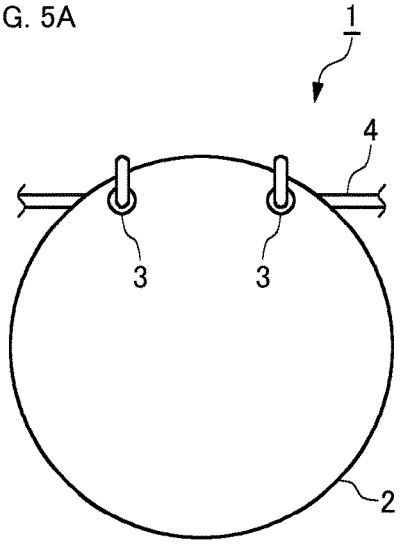
FIG. 5 A-D is a plan view of a sheet-like article with a string according to another embodiment.
Figure 5B:
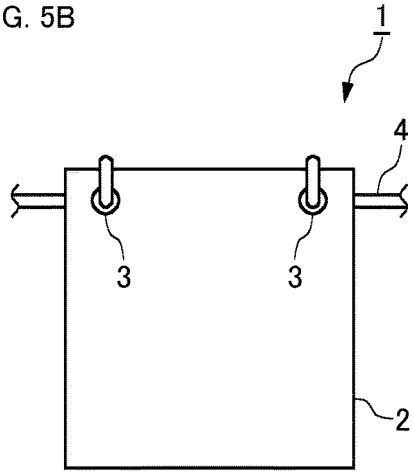
Figure 5C:
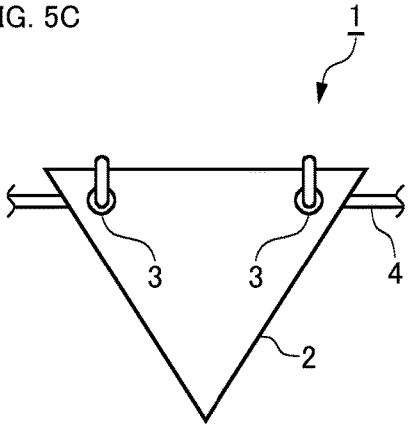
Figure 5D:
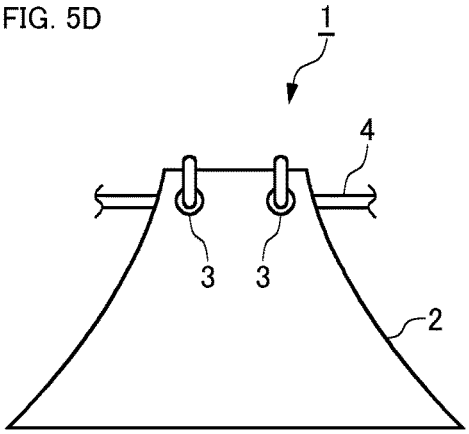
Figure 6A:
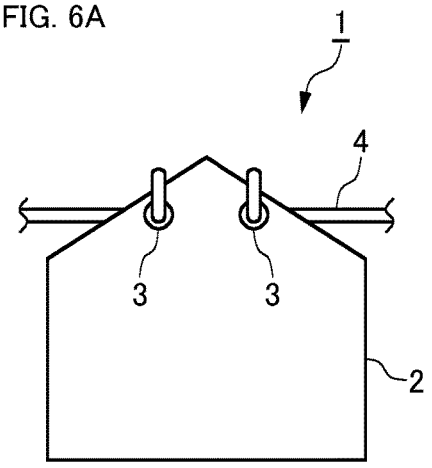
FIG. 6 A-D is a plan view of a sheet-like article with a string according to another embodiment.
Figure 6B:
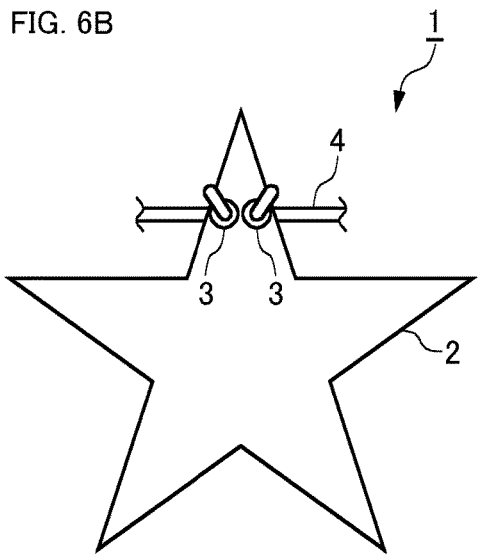
Figure 6C:
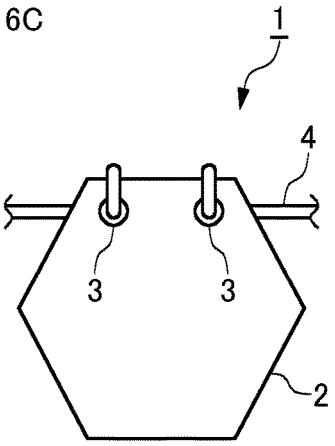
Figure 6D:
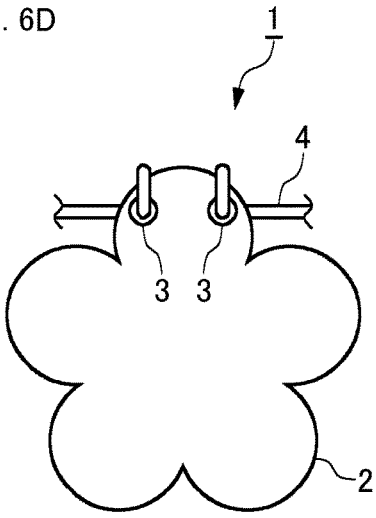

For example, in the above description, the two holes 3 (i.e., the two holes 3 in each of the first sheet 2A and the second sheet 2B) are provided in the sheet-like main body 2. However, the scope of the present invention is not limited to this, and the present invention can be implemented even when the three or more holes (i.e., three or more holes 3 in each of the first sheet 2A and the second sheet 2B) may be provided in the sheet-like main body 2. For example, the three holes 3 may be provided in the sheet-like main body 2 as illustrated in FIG. 4 (*a*), the four holes 3 may be provided in the sheet-like main body 2 as illustrated in FIG. 4 (*b*), or the five holes 3 may be provided in the sheet-like main body 2 as illustrated in FIG. 4 (*c*). Furthermore, although illustration is omitted herein, the six or more holes 3 may be provided in the sheet-like main body 2.

In the above description, the shape of the main body (the first sheet 2A and the second sheet 2B) is a rectangle. However, the scope of the present invention is not limited to this. The shape of the main body 2 (the first sheet 2A and the second sheet 2B) may be a circle as illustrated in FIG. 5(*a*), the shape of the main body 2 (the first sheet 2A and the second sheet 2B) may be a square as illustrated in FIG. 5(*b*), the shape of the main body 2 (the first sheet 2A and the second sheet 2B) may be a triangle as illustrated in FIG. 5(*c*), the shape of the main body 2 (the first sheet 2A and the second sheet 2B) may be a chevron as illustrated in FIG. 5(*d*).

The shape of the main body 2 (the first sheet 2A and the second sheet 2B) may be a pentagon as illustrated in FIG. 6(*a*), the shape of the main body 2 (the first sheet 2A and the second sheet 2B) may be a star shape as illustrated in FIG. 6(*b*), the shape of the main body 2 (the first sheet 2A and the second sheet 2B) may be a hexagon as illustrated in FIG. 6(*c*), the shape of the main body 2 (the first sheet 2A and the second sheet 2B) may be a flower shape as illustrated in FIG. 6(*d*).

Figure 7:
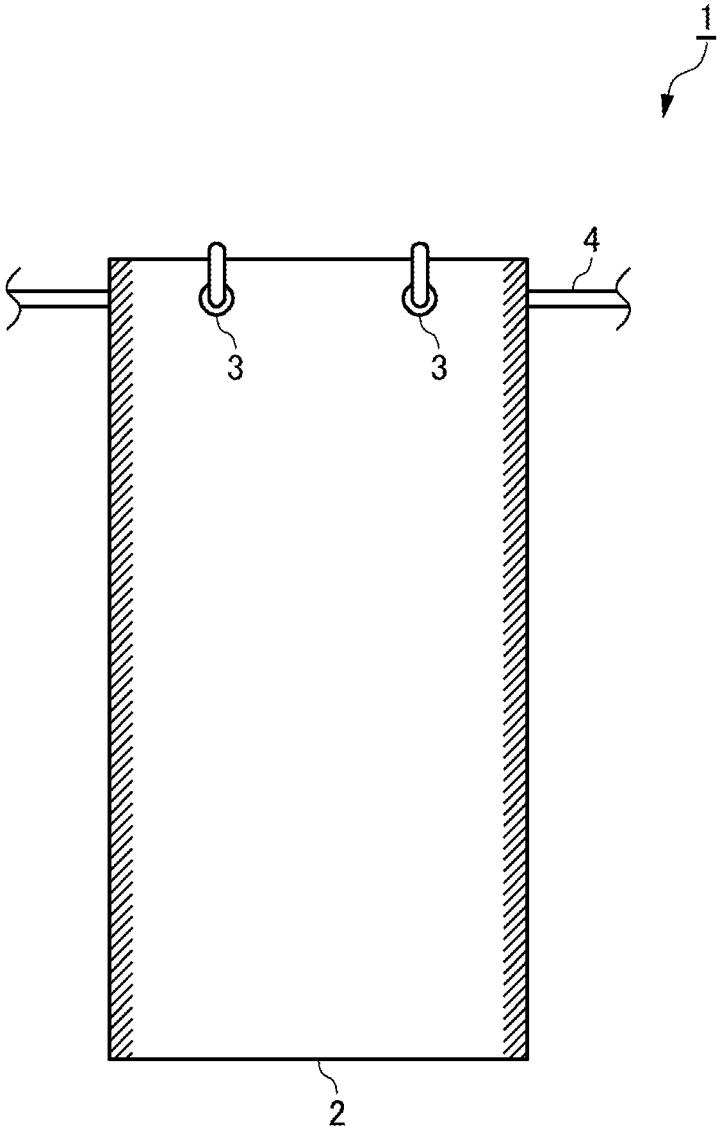
FIG. 7 is a plan view of a sheet-like article with a string according to another embodiment.

Furthermore, as illustrated in FIG. 7, in the first use form, inner surfaces of edge parts on left and right sides of the main body 2 (the first sheet 2A and the second sheet 2B) may be sealed by pasting (illustrated by hatching in FIG. 7) in the state where the main body 2 is closed. In this case, the string body 4 is pulled, so that the sealing is released, and the first use form can be changed to the second use form of the state where the main body 2 is open.

Figure 8:
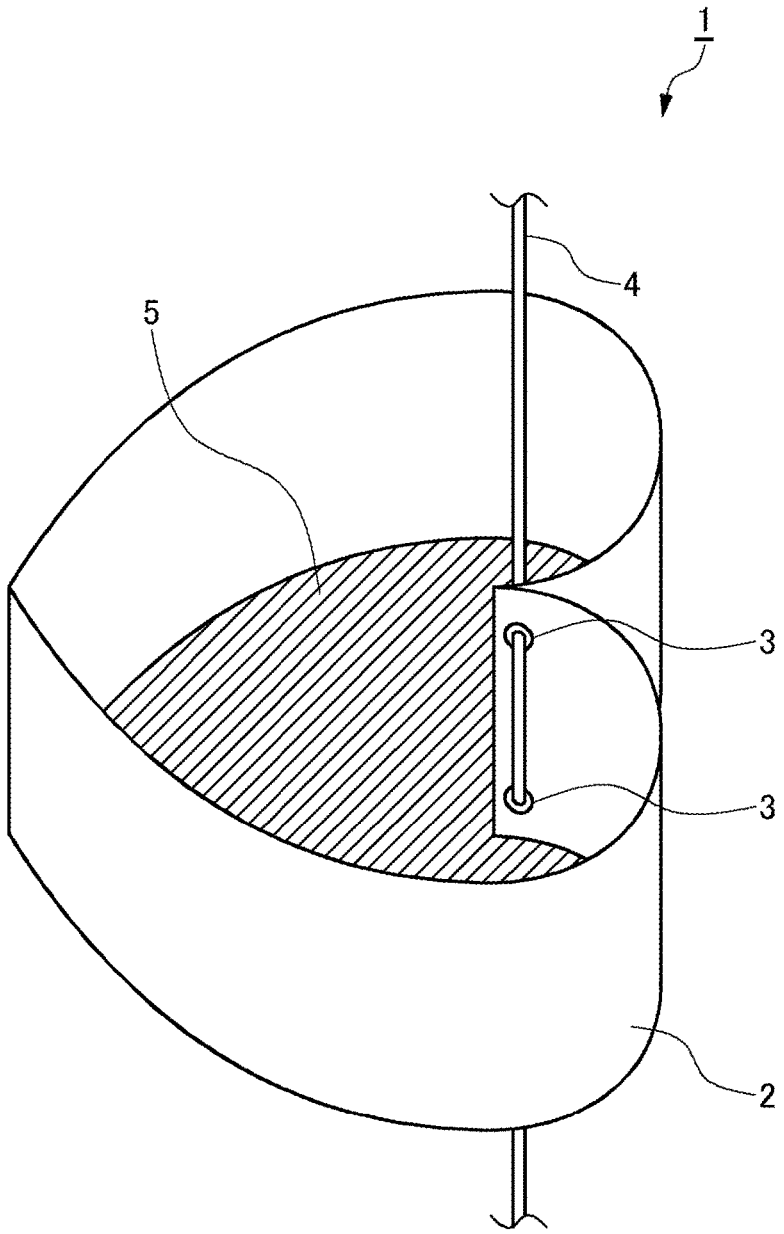
FIG. 8 is a perspective view of a sheet-like article with a string according to another embodiment.

As illustrated in FIG. 8, the main body 2 may include a foldable bottom surface 5. In this case, in the first use form, the bottom surface 5 is stored in the main body 2 in a folded state. The string body 4 is pulled, so that the first use form of the state where the bottom surface 5 is folded can be changed to the second use form of a state the where bottom surface 5 is developed planarly.

Figure 9:
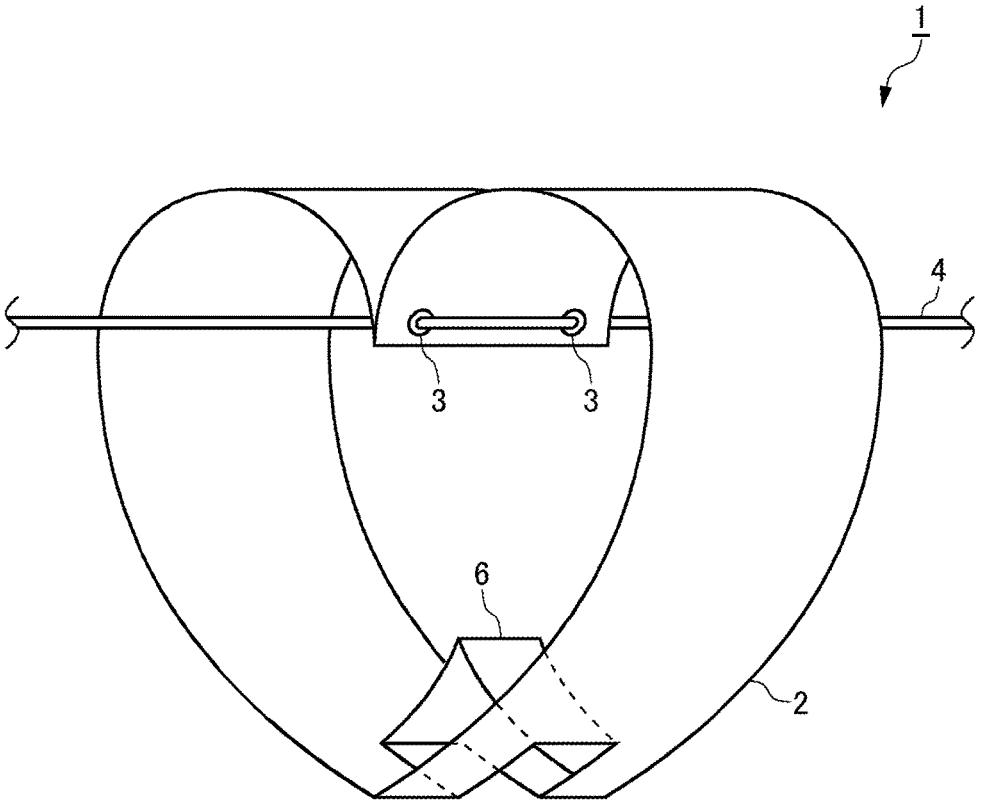
FIG. 9 is a perspective view of a sheet-like article with a string according to another embodiment.

Furthermore, as illustrated in FIG. 9, the main body 2 may include a foldable pop-up part 6. In this case, in the first use form, the pop-up part 6 is stored in the main body 2 in a folded state. The string body 4 is pulled, so that the first use form of the state where the pop-up part 6 is folded can be changed to the second use form of a state where the pop-up part 6 is developed three-dimensionally.

As described above, the sheet-like article with a string according to the present invention has an effect enabling use in the two use forms (the first use form and the second use form), and is used as, for example, a votive horse tablet, a business card, a name plate, a bookmark, or a chopsticks case having another use form, which is useful.

REFERENCE SIGNS LIST

1 SHEET-LIKE ARTICLE WITH A STRING
2 MAIN BODY
2A FIRST SHEET
2B SECOND SHEET
3 HOLE
3A FIRST HOLE
3B SECOND HOLE
3C THIRD HOLE
3D FOURTH HOLE
4 STRING BODY
5 BOTTOM SURFACE
6 POP-UP PART

What is claimed is:

1. A sheet-like article with a string having a first use form and a second use form, the sheet-like article with a string comprising:

a sheet-like main body comprising a first sheet, and a second sheet having a shape corresponding to the first sheet; and a string body inserted into a plurality of holes of the main body, wherein change from the first use form to the second use form is possible by pulling of the string body, wherein, in the first use form, the string body is bended at the hole of the main body, and in the second use form, the string body is arranged linearly by pulling, wherein, in the first use form, an inner surface of an end of the first sheet faces an inner surface of an end of the second sheet, and in the second use form, an outer surface of the end of the first sheet faces an outer surface of the end of the second sheet, and wherein, in the second use form in which the string body has been pulled, no fold is formed around the holes of the main body.

2. The sheet-like article with a string according to claim 1, wherein a first hole is provided on a first side of the end of the first sheet, a second hole is provided at a position corresponding to the first hole on a first side of the end of the second sheet, a third hole is provided on a second side of the end of the second sheet, a fourth hole is provided at a position corresponding to the third hole on a second side of the end of the first sheet, and in the first use form, the string body is:

inserted into the first hole from the inner surface to the outer surface of the end of the first sheet;

inserted into the second hole from the outer surface to the inner surface of the end of the second sheet;

inserted into the third hole from the inner surface to the outer surface of the end of the second sheet; and inserted into the fourth hole from the outer surface to the inner surface of the end of the first sheet.

3. The sheet-like article with a string according to claim 2, wherein the first sheet and the second sheet are connected to each other, in the first use form, the main body is in a closed state, and in the second use form, the main body is in an open state.

4. The sheet-like article with a string according to claim 3, wherein in the first use form, the main body is sealed by pasting in the closed state, and in the second use form, the sealing is released, and the main body is brought into the open state.

5. The sheet-like article with a string according to claim 3, wherein the main body includes a foldable bottom surface, in the first use form, the bottom surface is in a folded state, and in the second use form, the bottom surface is in a planarly developed state.

6. The sheet-like article with a string according to claim 3, wherein the main body includes a foldable pop-up part, in the first use form, the pop-up part is in a folded state, and in the second use form, the pop-up part is in a three-dimensionally developed state.

7. The sheet-like article with a string according to claim 1, wherein the first sheet and the second sheet are connected to each other, in the first use form, the main body is in a closed state, and in the second use form, the main body is in an open state.

8. The sheet-like article with a string according to claim 7, wherein in the first use form, the main body is sealed by pasting in the closed state, and in the second use form, the sealing is released, and the main body is brought into the open state.

9. The sheet-like article with a string according to claim 7, wherein the main body includes a foldable bottom surface, in the first use form, the bottom surface is in a folded state, and in the second use form, the bottom surface is in a planarly developed state.

10. The sheet-like article with a string according to claim 7, wherein the main body includes a foldable pop-up part, in the first use form, the pop-up part is in a folded state, and in the second use form, the pop-up part is in a three-dimensionally developed state.

* * * * *